US005474343A

United States Patent [19]

Ledbetter

[11] Patent Number: 5,474,343

[45] Date of Patent: Dec. 12, 1995

[54] SECURITY DEVICE FOR A DOOR

[76] Inventor: James W. Ledbetter, 2799 Octavia La., Marietta, Ga. 30062

[21] Appl. No.: 217,730

[22] Filed: Mar. 25, 1994

[51] Int. Cl.[6] ..... E05C 19/18

[52] U.S. Cl. ..... 292/259 R; 292/289

[58] Field of Search ..... 292/259 R, 289, 292/288; 49/394

[56] References Cited

U.S. PATENT DOCUMENTS

| | | | |
|---|---|---|---|
| 2,503,503 | 4/1950 | McGaffey | 292/259 R |
| 3,821,884 | 7/1974 | Walsh | 292/259 R X |
| 4,413,852 | 11/1983 | Burnell et al. | 292/259 R |
| 5,010,747 | 4/1991 | Norden, Jr. | 292/259 R |
| 5,077,940 | 1/1992 | La Rose, Jr. | 292/259 R X |
| 5,232,254 | 8/1993 | Teaff | 292/259 R |
| 5,282,656 | 2/1994 | Fizer | 292/259 R |

FOREIGN PATENT DOCUMENTS

| | | | |
|---|---|---|---|
| 2352936 | 12/1977 | France | 292/259 R |

*Primary Examiner*—Rodney M. Lindsey
*Attorney, Agent, or Firm*—Michael I. Kroll

[57] ABSTRACT

A security device is provided for a door in a doorway frame of a building, which consists of an elongated bar. A structure is for mounting the elongated bar in a removable manner within the doorway frame of the building across the door, to positively prevent forced entry from an opposite side of the door.

1 Claim, 2 Drawing Sheets

SECURITY DEVICE FOR A DOOR

BACKGROUND OF THE INVENTION

1. Field of the Invention

The instant invention relates generally to door braces and more specifically it relates to a security device for a door.

2. Description of the Prior Art

Numerous door braces have been provided in prior art that are adapted to extend between doorknobs and the floors in front of doors, which try to prevent intruders or burglars from opening the doors. They are difficult to install and position with respect to the doors. While these units may be suitable for the particular purpose to which they address, they would not be as suitable for the purposes of the present invention as heretofore described.

SUMMARY OF THE INVENTION

A primary object of the present invention is to provide a security device for a door that will overcome the shortcomings of the prior art devices.

Another object is to provide a security device for a door in which a metal bar of sufficient size placed across the door and into concealed latches under trim moulding, will positively prevent forced entry from the opposite side of the door.

An additional object is to provide a security device for a door that will maintain personal safety and be especially useful in high-crime areas.

A further object is to provide a security device for a door that is relatively simple to install and inexpensive for the benefits derived.

A still further object is to provide a security device for a door that can be painted and finished to blend with the decor of the door and surrounding parts of the room or building it is used in.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
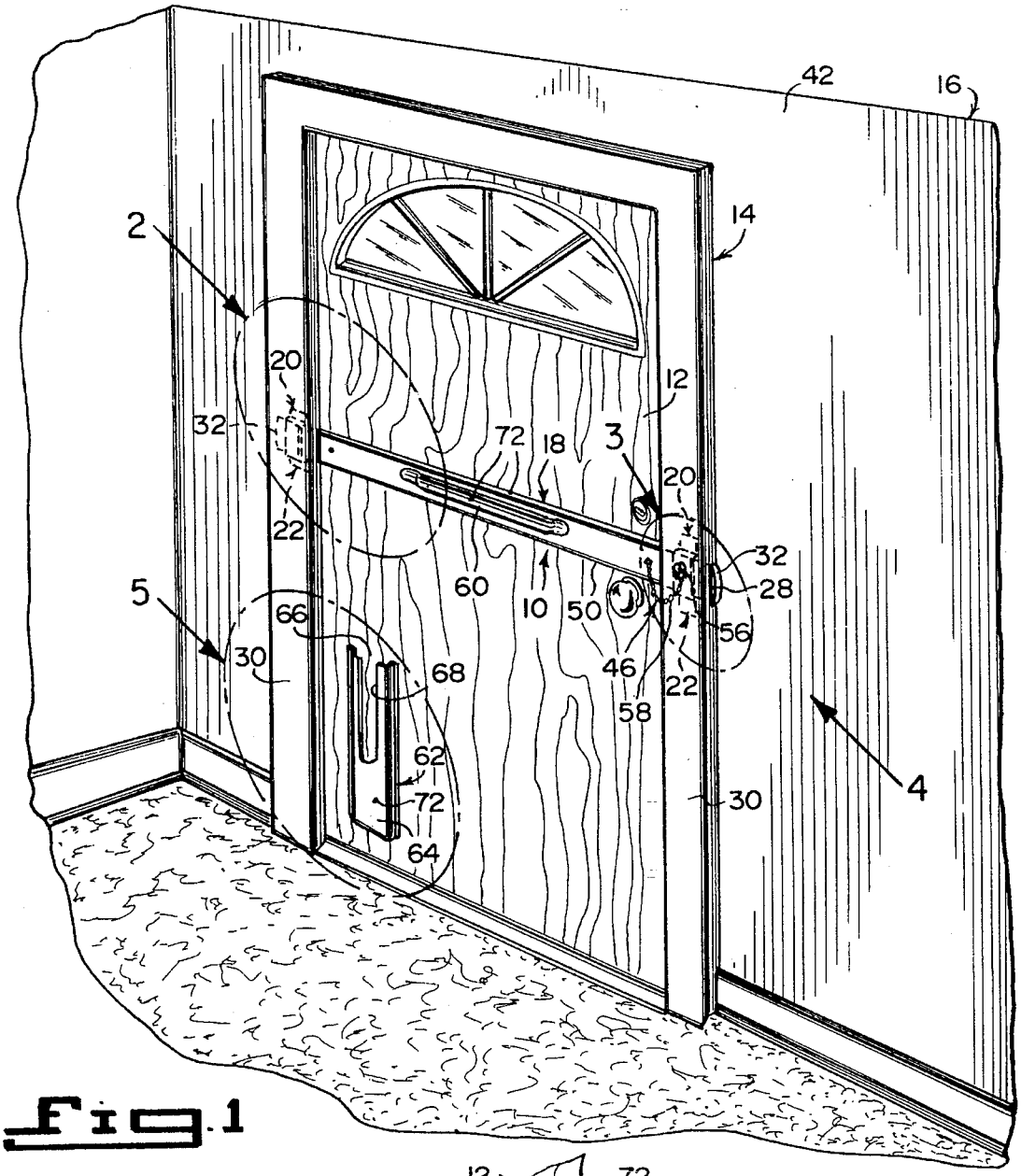
FIG. 1 is a perspective view of a door in a building with the instant invention installed and in use.
Figure 2:
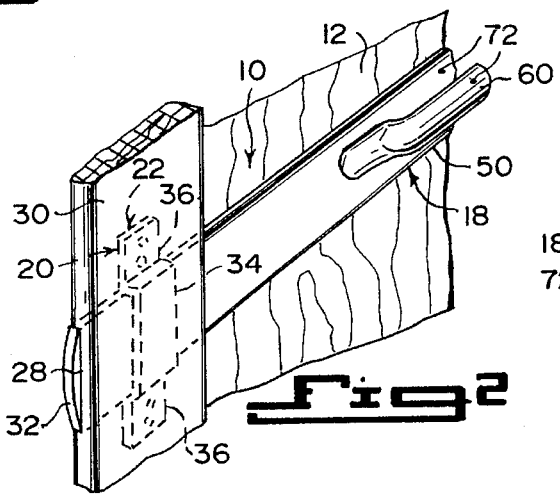
FIG. 2 is an enlarged perspective view as indicated by arrow 2 in FIG. 1, of a left side portion of the instant invention.
Figure 3:
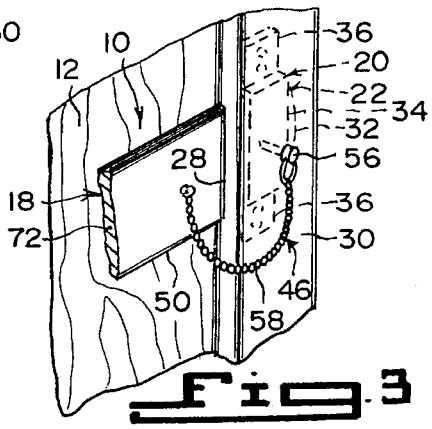
FIG. 3 is an enlarged perspective view as indicated by arrow 3 in FIG. 1, of a right side portion of the instant invention.

Turning now descriptively to the drawings, in which similar reference characters denote similar elements throughout the several views, FIGS. 1 through 5 illustrate a security device 10 for a door 12 in a doorway frame 14 of a building 16, which consists of an elongated bar 18. A structure 20 is for mounting the elongated bar 20 in a removable manner within the doorway frame 14 of the building 16 across the door 12, to positively prevent forced entry from an opposite side of the door 12.

The mounting structure 20 includes a pair of latch brackets 22. Components 24 are for attaching each latch bracket 22 to a wall stud side jamb 26 under a slotted area 28 in a trim moulding 30 on the doorway frame 14. The latch brackets 22 are hidden and can hold both ends 32 of the elongated bar 18 in a generally stationary position across the door 12.

Each latch bracket 22 i a strap 34 with two step down legs 36 on opposite sides thereof. Each step down leg 36 has at least one aperture 38 therethrough. The attaching components 24 are a plurality of fasteners 40, in which each fastener 40 will extend through each aperture 38 in each step down leg 36 and enter past a wall panel 42 and into the wall stud side jamb 26 of the doorway frame 14. Each fastener 40 is a wood screw 44.

Configurations 46 are for preventing an unauthorized removal of the elongated bar 18 by a person on the opposite side of the door 12. The removal preventing configurations 46 includes the elongated bar 18 having a notch 48 in one long edge 50 adjacent one end 32 being of a length equal to a width of one strap 34 of the latch bracket 22. When the one end 32 of the elongated bar 18 is inserted within the strap 34, the notch 48 will nest on the strap 34 of the latch bracket 22.

The elongated bar 18 has an aperture 52 therethrough adjacent one end 32. One of the straps 34 has an orifice 54 therethrough. A safety pin 56 is for insertion through a hole in the trim moulding 30, the orifice 54 in the strap 34 and into the aperture 52 in the elongated bar 18. The person on the opposite side of the door 12 will not be able to remove the elongated bar 18 therefrom. A lanyard 58 extends between the safety pin 56 and the elongated bar 18, to prevent the accidental loss of the safety pin 56.

The elongated bar 18 contains a handle 60 attached thereto, to facilitate installation and removal of the elongated bar 18 with respect to the straps 34. A storage case 62 is affixed onto the door 12, so that the elongated bar 18 can be inserted into the storage case 62 when not in use.

Figures 4, 5:
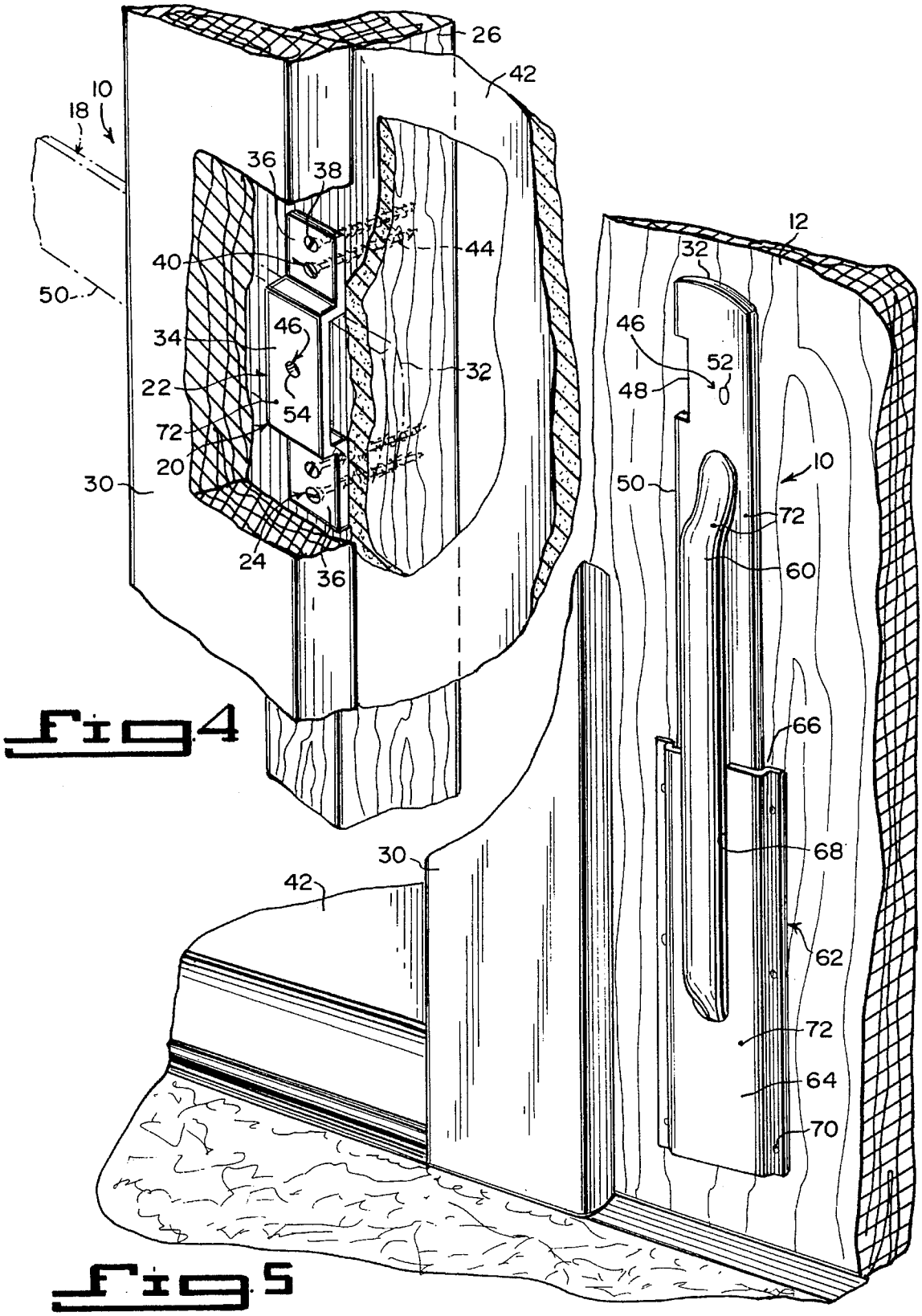
FIG. 4 is a still further enlarged perspective view taken in the direction of arrow 4 in FIG. 1, with parts broken away and in phantom.
FIG. 5 is an enlarged perspective view as indicated by arrow 5 in FIG. 5, showing the bar in the storage case when not in use.

The storage case 62 includes a housing 64, having an open top 66 with a slot 68 extending downwardly therefrom. A plurality of fasteners 70 are for attaching the housing 64 to the door 12 in a vertical position. The elongated bar 18 can be inserted into the open top 66 with the handle 60 fitting into the slot 68, as shown in FIG. 5.

The elongated bar 18 with the handle 60, the straps 34 and the housing 64 of the storage case 62 are all fabricated out of a strong durable material 72. The strong durable material 72 can be metal, composite, plastic, wood and similar items.

OPERATION OF THE INVENTION

To use the security device 10, the following steps should be taken:

1. Grasp the handle 60 on the elongated bar 18.
2. Insert one end 32 of the elongated bar 18 into a strap 34.

3. Insert another end 32 of the elongated bar 18 into another strap 34.
4. Allow the notch 48 in the elongated bar 18 to nest on one of the straps 34.
5. Press the safety pin 56 through the hole in the trim moulding 30, the orifice 54 in the strap 34 and into the aperture 52 in the elongated bar 18, to hold the elongated bar 18 securely within the strap 34.

| LIST OF REFERENCE NUMBERS | |
|---|---|
| 10 | security device |
| 12 | door |
| 14 | doorway frame |
| 16 | building |
| 18 | elongated bar |
| 20 | mounting structure |
| 22 | latch bracket |
| 24 | attaching component |
| 26 | wall stud side jamb |
| 28 | slotted area in 30 |
| 30 | trim moulding |
| 32 | end of 18 |
| 34 | strap for 22 |
| 36 | step down leg on 34 |
| 38 | aperture in 36 |
| 40 | fastener for 24 |
| 42 | wall panel |
| 44 | wood screw for 40 |
| 46 | removal preventing configurations |
| 48 | notch in 50 |
| 50 | long edge of 18 |
| 52 | aperture in 18 |
| 54 | orifice in 34 |
| 56 | safety pin |
| 58 | lanyard |
| 60 | handle on 18 |
| 62 | storage case |
| 64 | housing |
| 66 | open top in 64 |
| 68 | slot in 64 |
| 70 | fastener in 64 |
| 72 | strong durable material |

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A security device for a door in a doorway frame of a building which comprises:

a) an elongated bar having a handle thereon; and b) means for mounting said elongated bar in a removable manner within the doorway frame of the building across the door, to positively prevent forced entry from an opposite side of the door;

c) said mounting means including a pair of latch brackets and wood screw means for attaching each said latch brackets to a wall stud side jamb under a slotted area in a trim moulding on opposite sides of the door frame, so that said latch brackets are hidden and can hold both ends of said elongated bar in a generally stationary position across said door, each said latch bracket including a strap with two step down legs on opposite sides thereof, each said step down leg having at least one aperture therethrough for accommodating opposite sides of said bar;

d) means for preventing, an unauthorized removal of said elongated bar by a person on the opposite side of the door comprising said elongated bar having a notch in one long edge adjacent one end being of a length equal to a width of one said strap of said latch bracket, so that when the one end of said elongated bar is inserted within said strap, said notch will nest one said strap of said latch bracket, an aperture through said elongated bar adjacent one end, one of said straps having an orifice therethrough, a safety pin for insertion through an orifice in the trim moulding and said orifice in said strap and into said aperture in said elongated bar, so that the person on the opposite side of the door will not be able to remove said elongated bar therefrom, and a lanyard extending between said safety pin and said elongated bar to prevent the accidental loss of said safety pin; and e) a storage case affixed onto the door, so that said elongated bar can be inserted into said storage case when not in use, said storage case including a housing having an open top with a slot extending downwardly therefrom and a plurality of fasteners for attaching said housing to the door in a vertical position, so that said elongated bar can be inserted into said open top with said handle fitting into said slot.

* * * * *